US005508798A

United States Patent [19]

Yamada

[11] Patent Number: 5,508,798

[45] Date of Patent: Apr. 16, 1996

[54] IMAGE FORMING METHOD AND APPARATUS WHICH DETERMINE STAPLING POSITION USING AN ORIENTATION BY AN IMAGE AND A SHEET FEED DIRECTION

[75] Inventor: Kenji Yamada, Tokyo, Japan

[73] Assignee: Ricoh Company, Ltd., Tokyo, Japan

[21] Appl. No.: 106,633

[22] Filed: Aug. 16, 1993

[30] Foreign Application Priority Data

Aug. 19, 1992 [JP] Japan ..... 4-241459

[51] Int. Cl.[6] ..... G03G 21/00

[52] U.S. Cl. ..... 355/324; 270/53

[58] Field of Search ..... 355/203, 204, 355/205, 206, 208, 209, 308, 309, 77, 321, 324; 271/184, 185, 287; 270/37, 53

[56] References Cited

U.S. PATENT DOCUMENTS

| | | | |
|---|---|---|---|
| 4,891,681 | 1/1990 | Fiske et al. | 355/324 X |
| 5,029,831 | 7/1991 | Green | 270/53 |
| 5,083,760 | 1/1992 | Yamazaki et al. | 270/53 |
| 5,177,548 | 1/1993 | Nakamura et al. | 355/324 |
| 5,229,812 | 7/1993 | Toyama et al. | 270/53 X |
| 5,236,189 | 8/1993 | Ikoma | 270/53 X |
| 5,257,081 | 10/1993 | Kato et al. | 355/324 |

FOREIGN PATENT DOCUMENTS

| | | | |
|---|---|---|---|
| 0023154 | 1/1990 | Japan | 355/324 |

*Primary Examiner*—Sandra L. Brase
*Attorney, Agent, or Firm*—Oblon, Spivak, McClelland, Maier & Neustadt

[57] ABSTRACT

An image forming apparatus having a finisher capable of stapling a stack of sheets at any one of a plurality of positions. The apparatus automatically determines a stapling position matching the orientation of an image and a sheet feed direction, thereby reducing defective stapling.

28 Claims, 8 Drawing Sheets

Fig. 7b (II)

Fig. 7c (III)

Fig. 7g (VII)

Fig. 7h (VIII)

S
あいうえお
かきくけこ
P1
Fig. 8b (II)
S
ABCDE
P2
Fig. 8c (III)
S
あいうえお
かきくけこ
P3
Fig. 8d (IV)
S
ABCDEF
P4

S
あいうえお
かきくけこ
P5
Fig. 8f (VII)
S
ABCDEFG
P6
Fig. 8g (VIII)
S
あいうえお
かきくけこ
P7
Fig. 8h (IX)
S
ABCDE
P8

S
P1
Fig. 8b (II)
S
P2
Fig. 8c (III)
S
P3
Fig. 8d (IV)
S
P4

S
P5
Fig. 8f (VII)
S
P6
Fig. 8g (VIII)
S
P7
Fig. 8h (IX)
S
P8

IMAGE FORMING METHOD AND APPARATUS WHICH DETERMINE STAPLING POSITION USING AN ORIENTATION BY AN IMAGE AND A SHEET FEED DIRECTION

BACKGROUND OF THE INVENTION

The present invention relates to an image forming apparatus having a finisher capable of stapling a stack of sheets at any one of a plurality of positions.

Copiers, printers or similar image forming apparatuses having a finisher are extensively used today. Conventional finishers include one capable of sorting sheets carrying images thereon and then stapling a stack of such sheets together. Moreover, some finishers with such a stapling function are selectively operable in any one of modes for stapling a sheet stack at a single predetermined point and modes for stapling it at a plurality of predetermined points.

However, the problem with a finisher operable in such different modes is that the stapling position or positions have to be selected in consideration of the orientation of documents, sheet feed direction, and the orientation of characters (image). This requires troublesome operation and, therefore, often results in defective stapling.

SUMMARY OF THE INVENTION

It is, therefore, an object of the present invention to provide an image forming apparatus which frees a finisher thereof from defective stapling.

An image forming apparatus having a finisher capable of selecting a plurality of stapling positions of the present invention comprises a recognizing device for recognizing the orientation of an image, and a control device for automatically determining a stapling position on the basis of the orientation of an image and a sheet feed direction.

BRIEF DESCRIPTION OF THE DRAWINGS

The above and other objects, features and advantages of the present invention will become more apparent from the following detailed description taken with the accompanying drawings in which:

FIG. 9 demonstrates single point stapling and two point stapling.

DESCRIPTION OF THE PREFERRED EMBODIMENT

Figure 1:
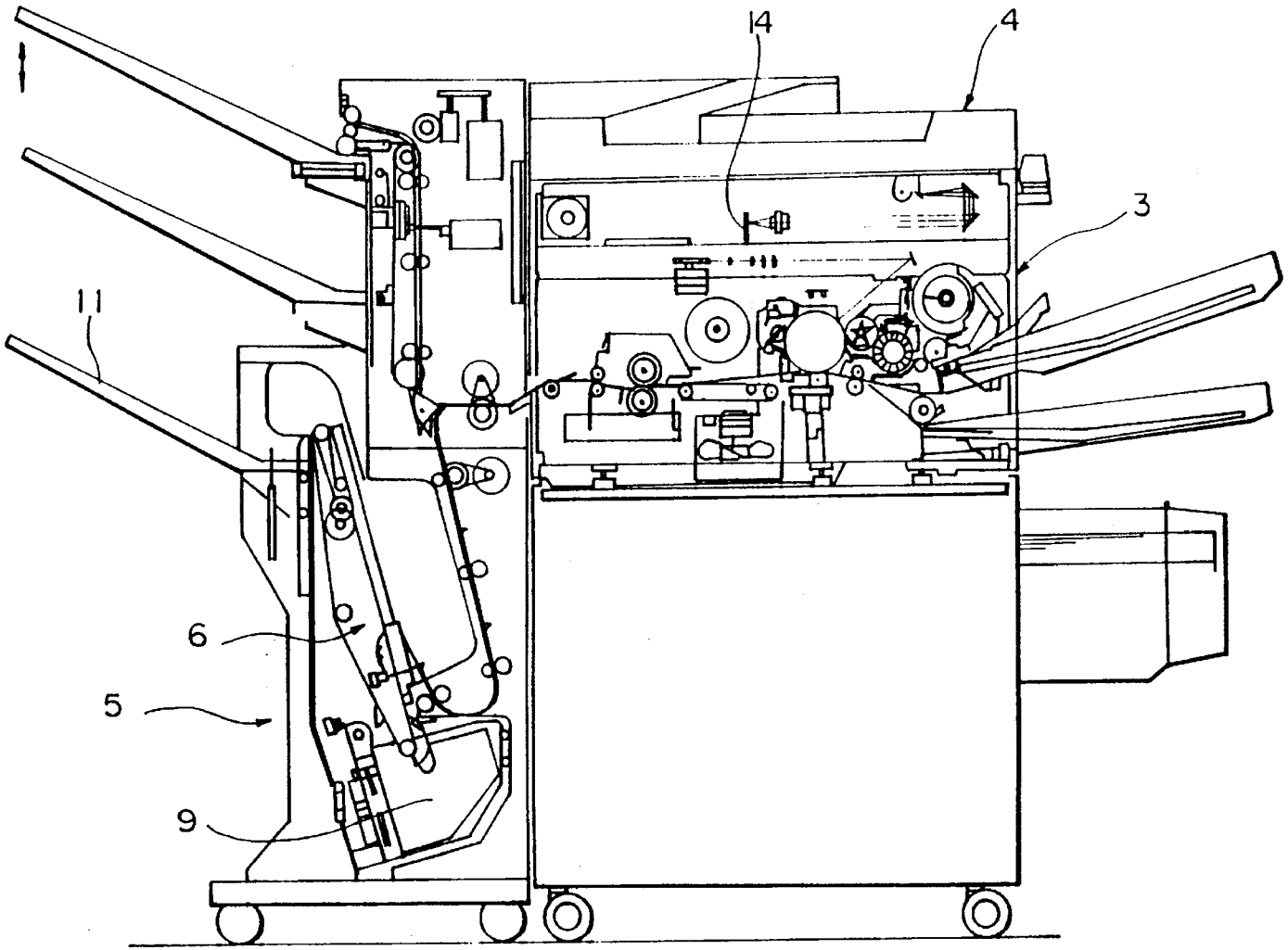
FIG. 1 is a section showing an image forming apparatus embodying the present invention.

As shown in FIG. 9, some conventional finishers applicable to a copier, printer or similar image forming apparatus are operable in three different staple modes (I), (II) and (III). In the mode (I), the finisher staples a stack of sheets S at a single point P adjacent to the upper left corner, as viewed in the figure. In the mode (II), the finisher staples the sheets S at a single point P adjacent to the lower left corner. Further, in the mode (III), the finisher staples the sheets S at two spaced points P lying in the left margin. The problem with with this type of finisher is that the stapling position or positions have to be selected in consideration of the orientation of documents, sheet feed direction, and the orientation of characters (image), as stated earlier. This requires troublesome operation and, therefore, often results in defective stapling.

Referring to FIGS. 1–4, an image forming apparatus with a finisher embodying the present invention is shown and implemented as a digital copier by way of example. As shown, the copier, generally 3, is provided with a recycling document handler (RDH) 4 and a finisher 5. The RDH 4 may be replaced with an automatic document feeder (ADF) if the copier 3 has an electronic sorting function. Sheets, or copies, sequentially coming out of the copier 3 are introduced into the finisher 5 and routed through a path indicated by a thick line in FIG. 1 to a staple tray 6. Every time a sheet is stacked on the staple tray 6, jogger fences 7 and 8 are operated to position it. After the last sheet has been stacked on the staple tray 6, a stapler 9 is actuated to staple the whole stack of sheets. The stapled sheet stack is transported to a stack tray 11 by a belt 10 having pawls. The stapler 9 is mounted on a base 12 and driven by a staple motor 15 to move in a direction parallel to the trailing edge of the sheet stack.

The copier 3 having the above construction has various functions, as follows. To begin with, the copier 3 automatically determines a stapling position matching the orientation of an image (horizontal writing or vertical writing) and the sheet feed direction (longitudinal feed or lateral feed). When a two point staple command is entered on the copier 3 by the operator, the copier 3 inhibits the stapling position from being automatically determined. When the stapling position is inhibited from being automatically determined, the copier 3 urges the operator to enter a desired stapling position in a manual mode. Also, in such a condition, the copier 3 produces an alarm for urging the operator to change the orientation of documents. When the operator enters a desired stapling position in the manual mode, the copier 3 compares it with an automatically determined position and, if the former differs from the latter, produces an alarm. When stapling is continuously repeated at the same stapling position, the copier 3 simply causes the second and successive sets of copies to be stapled at the same position as the first set of copies. The copier 3 is capable of determining a stapling position on the basis of the page corresponding to the cover of a stack of documents. Moreover, when two point stapling is commanded by the operator, the copier 3 determines whether or not the beginning of the writing is located at the stapling side and, if the result of decision is negative, produces an alarm.

Figure 4:
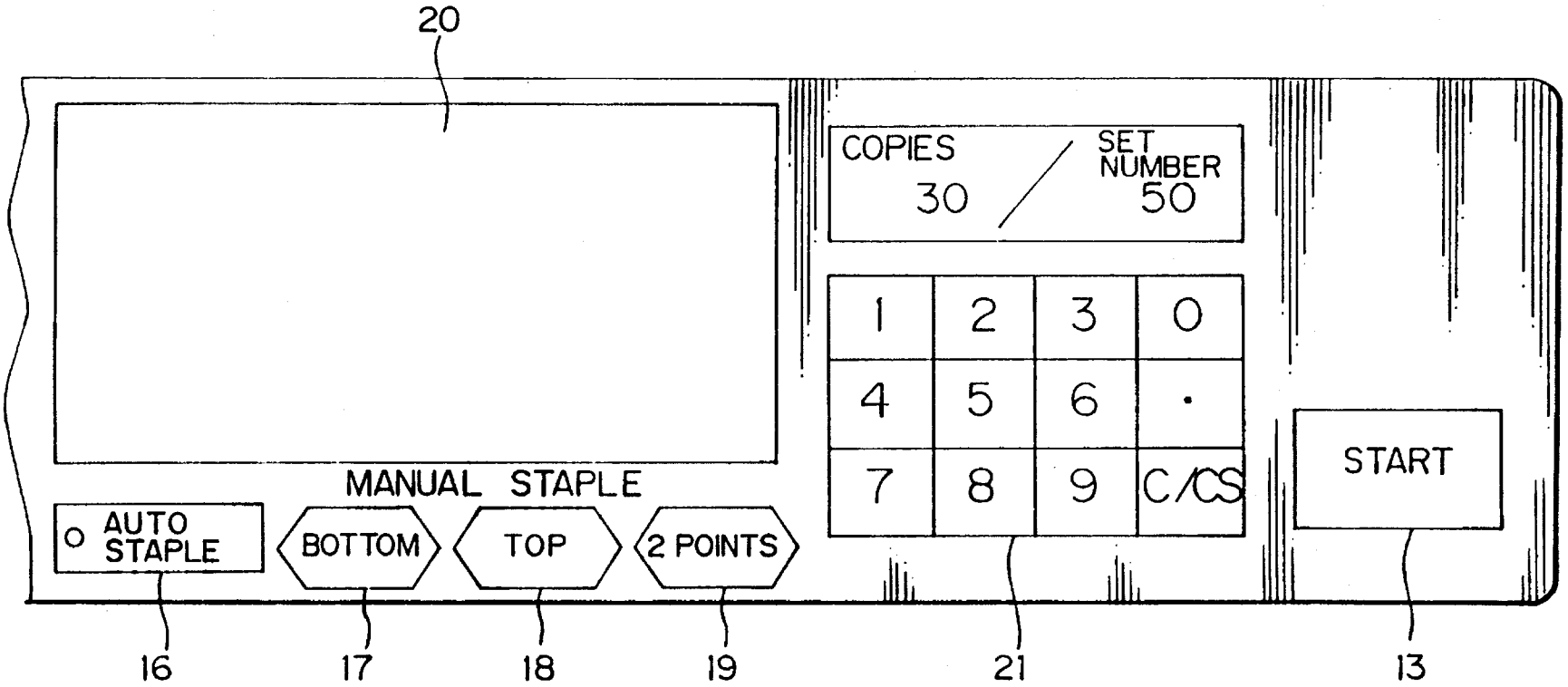
FIG. 4 is a view showing a specific arrangement of an operation panel provided on the apparatus of FIG. 1.

FIG. 4 shows a specific arrangement of an operation panel provided on the copier 3. As shown, the operation panel includes a copy start button 13, an automatic staple key, manual staple keys 17, 18 and 19, a display 20, and numeral keys 21.

Figure 5:
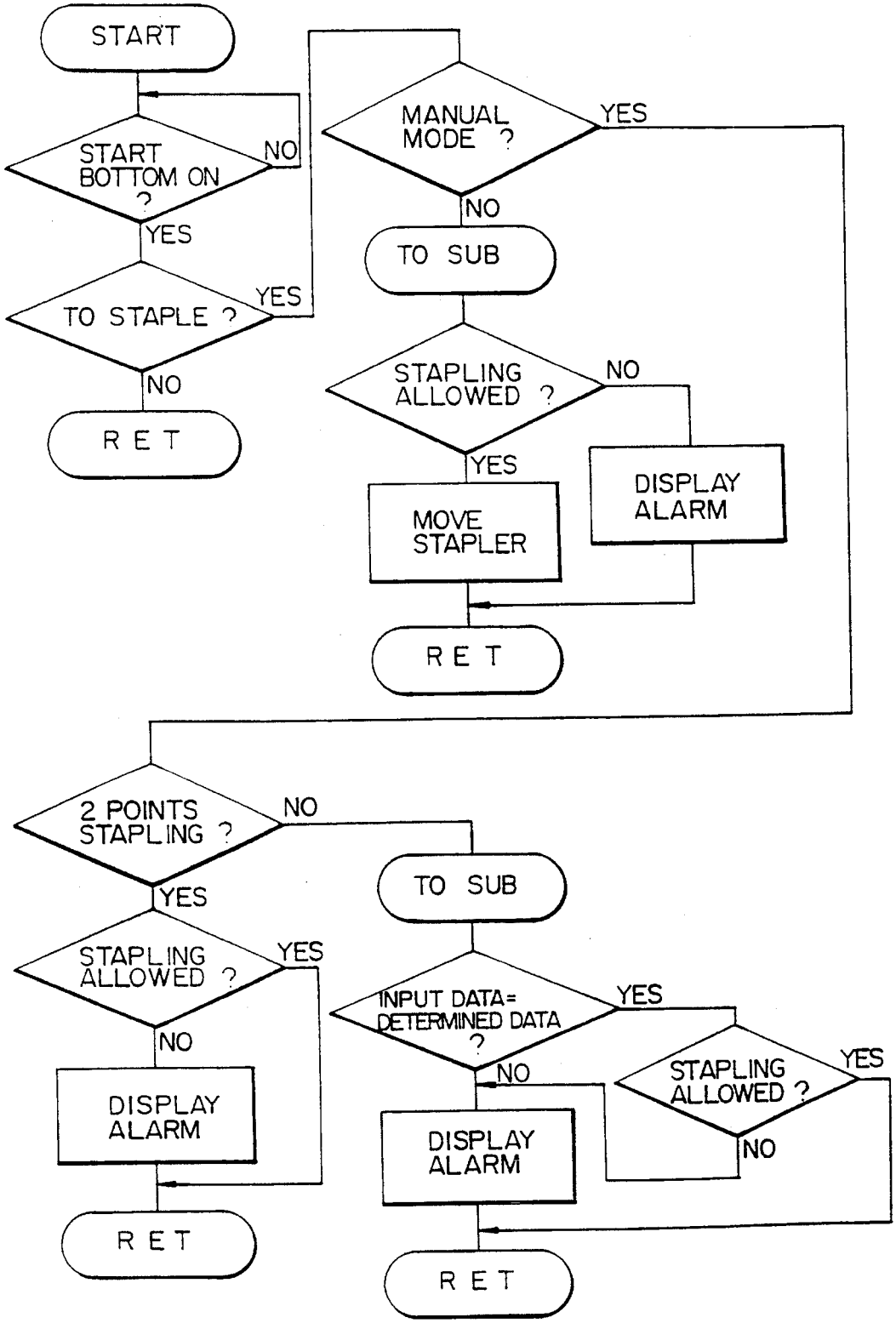
FIG. 5 is a flowchart representative of a main routine to be executed by the embodiment.
Figure 6:
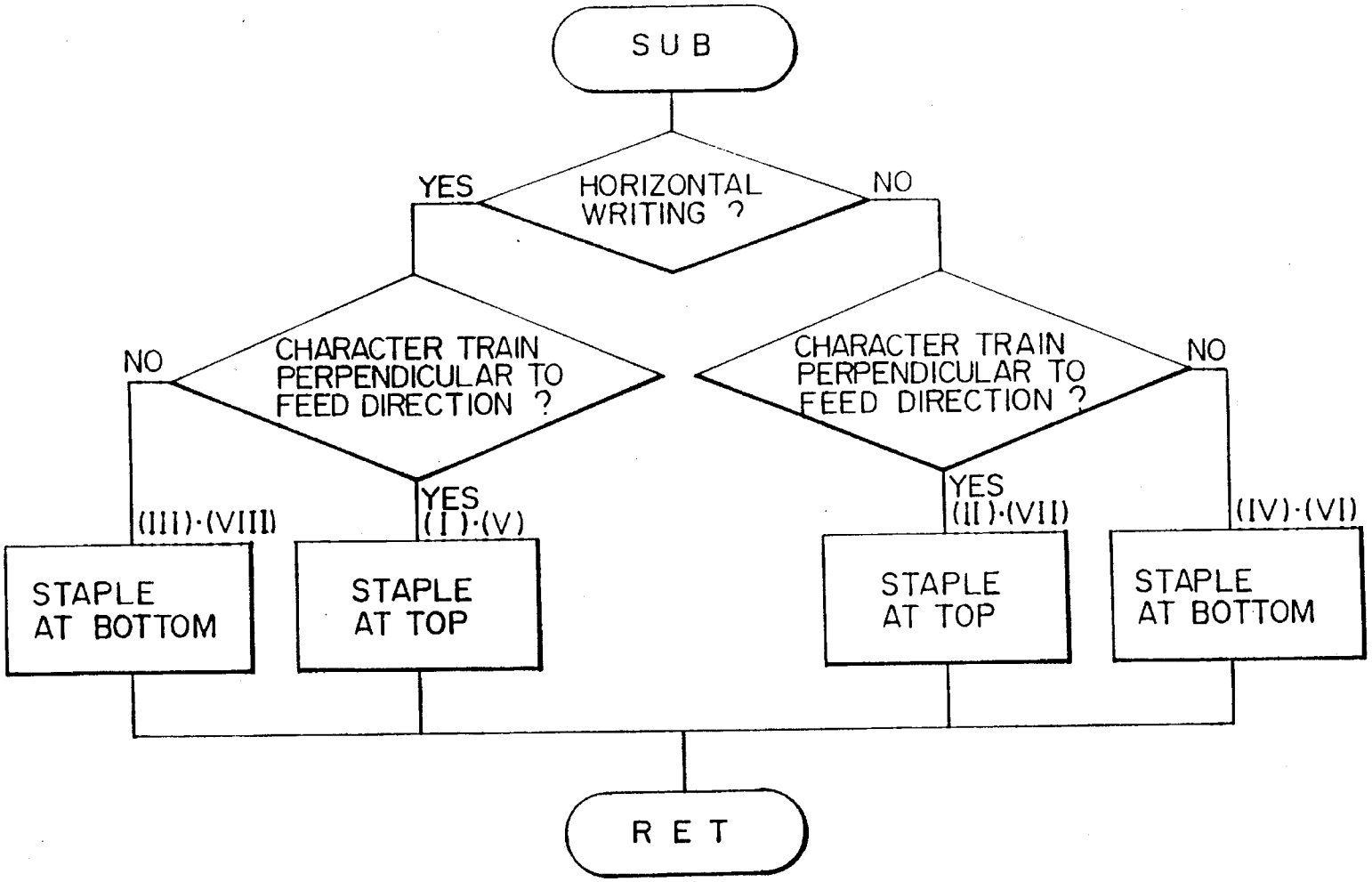
FIG. 6 is a flowchart representative of a subroutine included in the main routine.
Figure 7A:
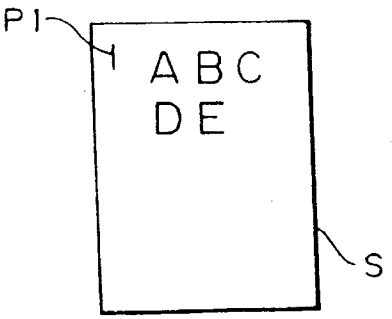
FIG. 7 shows stapling positions which allow stapling to be performed.
Figure 7A:
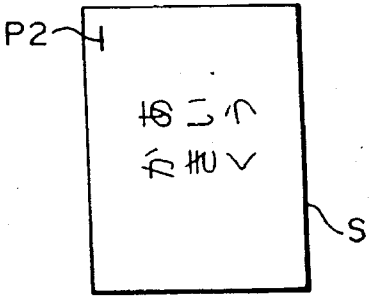
Figure 7A:
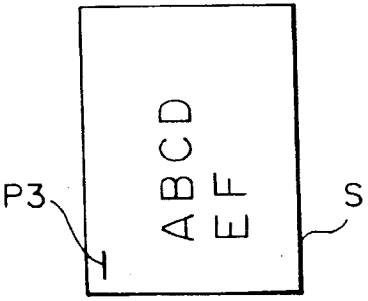
Figure 7A:
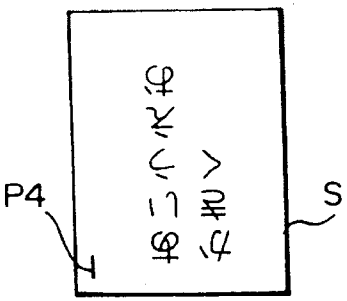
Figure 7E:
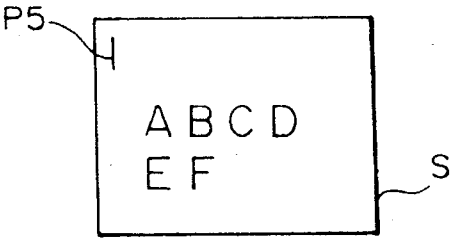
Figure 7E:
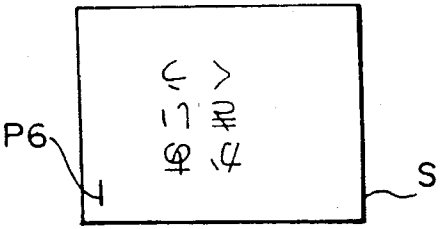
Figure 7E:
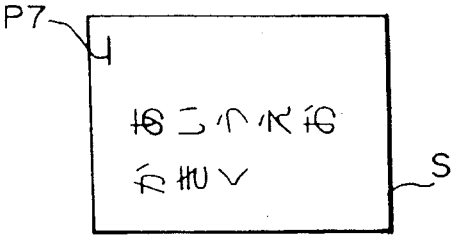
Figure 7E:
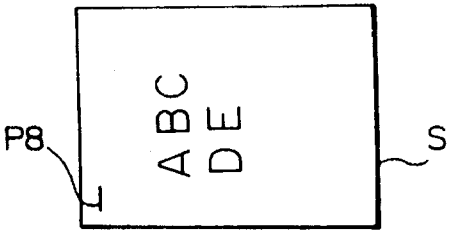
Figures 8A, 8E:
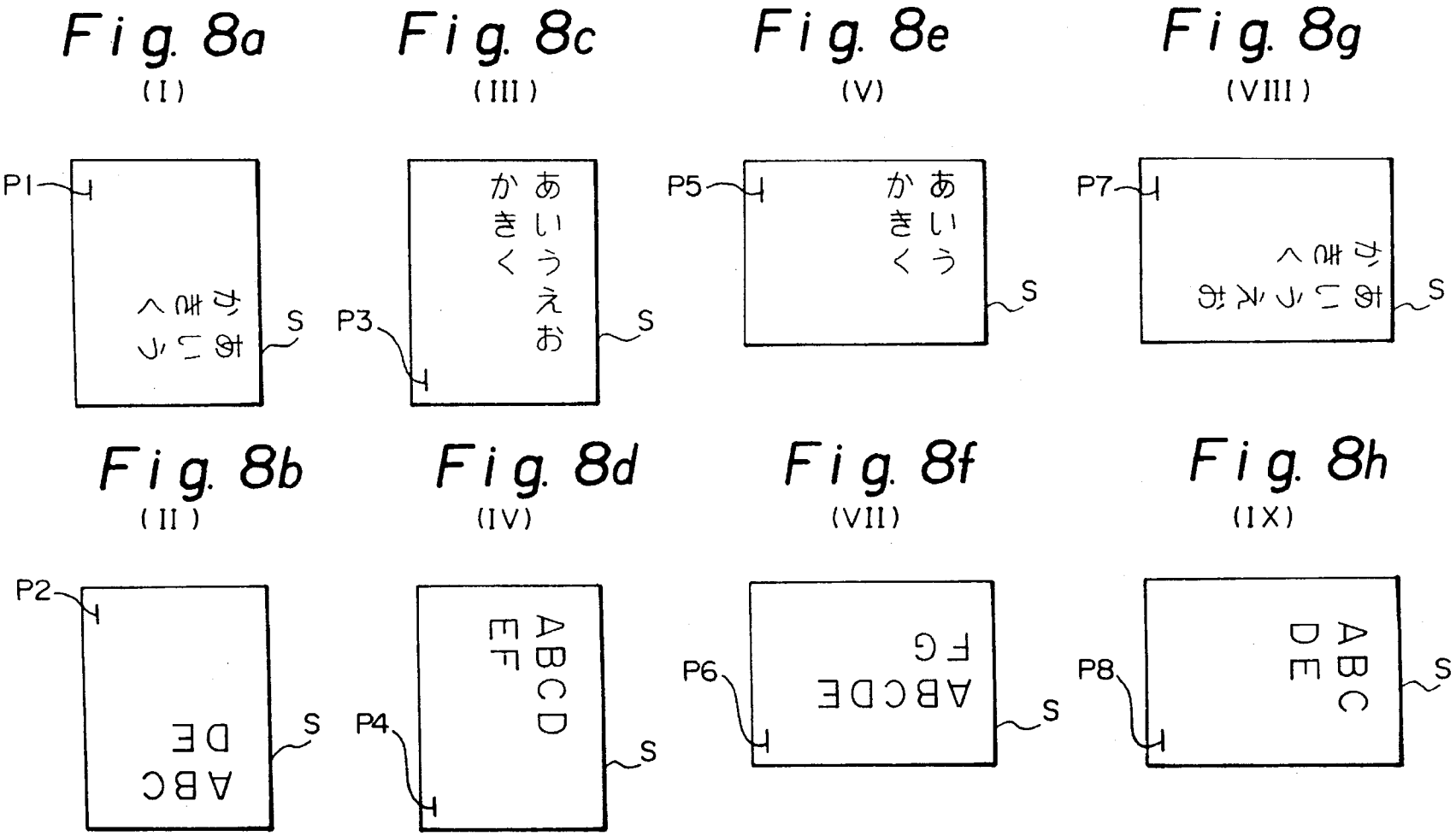
FIG. 8 shows stapling positions which do not allow stapling.
Figures 8A, 8E:
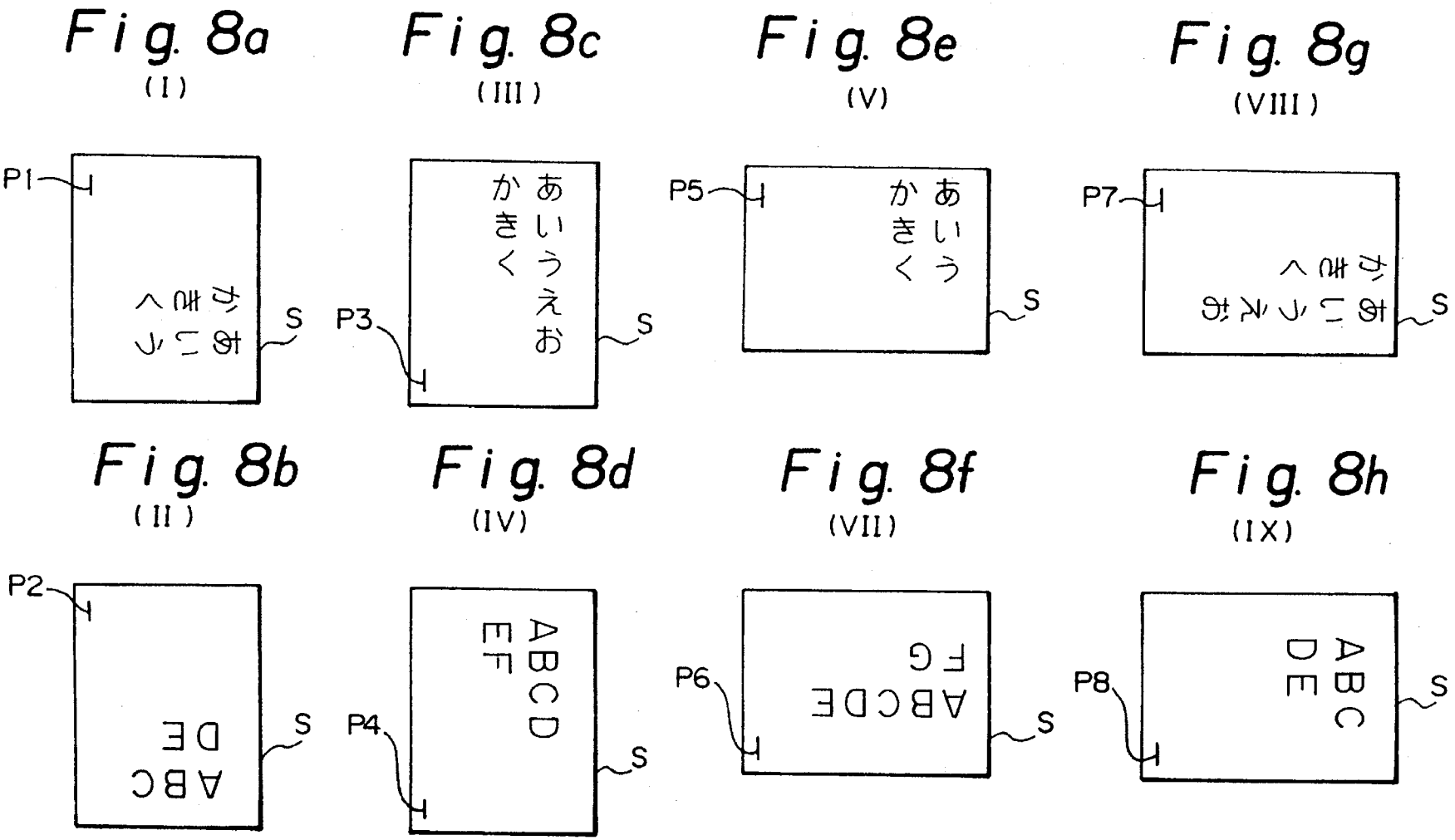

A reference will be made to FIGS. 5 and 6 for describing a control procedure particular to the embodiment. Assume that the operator has set a stack of documents on the RDH 4 and then pressed the copy start button 13. Then, the copier 3 determines a finishing mode desired by the operator. At this instant, the RDH 4 sends data representative of a document feed direction to the copier 3. As a document is fed by the RDH 4 to a glass platen (see FIG. 1), the copier 3 reads it with a CCD (Charge Coupled Device) array 14, FIG. 1, to determine the orientation of the document image. This is done on the basis of the page corresponding to the cover of the documents. Whether the page corresponding to the cover is fed first or last is determined by the RDH 4 itself beforehand. The copier 3 determines a stapling position in response to data representative of a copy feed direction and data representative of the image orientation. At the same time, the copier 3 determines whether or not the image orientation is one which allows stapling to be performed. It is to be noted that the image orientation which allows stapling is any one of orientations (I)–(VIII) shown in FIG. 7. FIG. 8 shows image orientations (I)–(IX) which do not allow stapling; when documents are set such that sheets S will be discharged in any one of the orientations (I)–(IX) of FIG. 8, stapling is inhibited. In the subroutine shown in FIG. 6, (I)–(VII) correspond to (I)–(VII) of FIG. 7, respectively.

Figure 2:
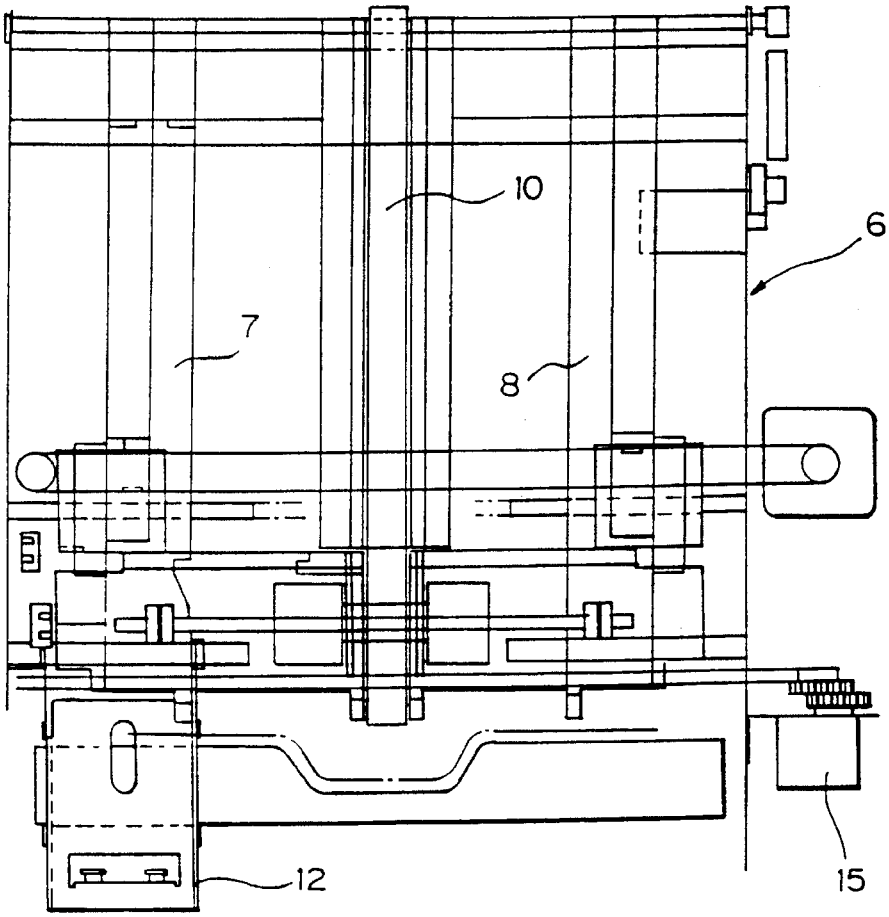
FIG. 2 is an enlarged side elevation of a staple tray included in a finisher forming part of the embodiment.
Figure 3:
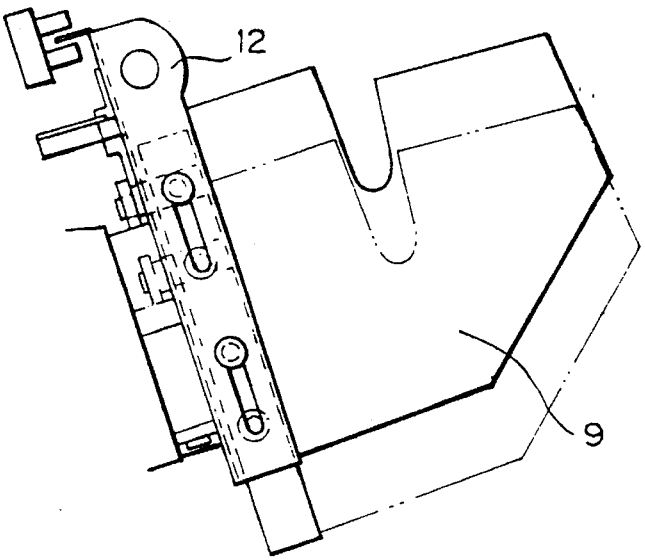
FIG. 3 is an enlarged view of a stapler included in the finisher.

When an automatic staple mode is selected on the automatic staple key 16, FIG. 4, the copier 3 determines a stapling position and, if stapling is allowed, drives the staple motor 15, FIG. 2. As a result, the stapler 9 is moved to the position determined by the copier 3. If stapling is not allowed, the copier produces an alarm message, e.g., "Enter a stapling position or reorient documents" on the display 20, FIG. 4. This is successful in reducing defective stapling.

Further, when the operator selects either of top stapling or bottom stapling on the manual staple key 18 or 17, FIG. 4, the copier 3 determines a stapling position and whether or not stapling is allowed. If the result of this decision is negative, the copier 3 produces an alarm message, e.g., "Change stapling position" on the display 20. This is also successful in reducing defective stapling.

On the other hand, when the operator selects two point stapling on the two point key 19, FIG. 4, the copier 3 determines whether or not stapling is allowed and, if it is not allowed, displays an alarm message, e.g., "Check stapling position" or "Reverse document orientation". Consequently, documents are prevented from being set on the RDH 4 in a wrong orientation.

In summary, it will be seen that the present invention provides an image forming apparatus having various unprecedented advantages, as enumerated below.

(1) The apparatus automatically determines a stapling position matching the orientation of an image and a sheet feed direction, thereby reducing defective stapling.

(2) When a two point staple command is entered on the apparatus in a manual mode, the apparatus inhibits the stapling position from being automatically determined. This allows a sheet stack to be surely stapled at two points.

(3) When the stapling position is inhibited from being automatically determined, the apparatus urges the operator to enter a desired stapling position in a manual mode. Also, in such a condition, the apparatus produces an alarm for urging the operator to change the orientation of documents. Therefore, even when documents are accidentally oriented such that the end of a writing is located on the stapling side, they can be readily recovered.

(4) When the operator enters a desired stapling position in the manual mode, the apparatus compares it with an automatically determined position and, if the former differs from the latter, produces an alarm. The apparatus, therefore, prevents the operator from entering unexpected commands.

(5) When the same stapling operation is continuously performed, the apparatus simply causes the second and successive sets of copies to be stapled at the same position as the first set of copies, thereby enhancing productivity.

(6) The apparatus determines a stapling position on the basis of the page corresponding to the cover of a stack of documents and is, therefore, free from erroneous decision on the stapling position.

(7) When two point stapling is commanded by the operator, the apparatus determines whether or not the beginning of the writing is located at the stapling side and, if the result of decision is negative, produces an alarm. This insures accurate orientation of documents in the two point staple mode.

Various modifications will become possible for those skilled in the art after receiving the teachings of the present disclosure without departing from the scope thereof.

What is claimed is:

1. An image forming apparatus having a finisher with a plurality of stapling positions, comprising:

recognizing means for recognizing at least one of an angular orientation of characters of an image and whether the characters of the image are read horizontally relative to the angular orientation of the characters; and control means, connected to the recognizing means, for automatically determining a stapling position on the basis of a sheet feed direction and said at least one of the angular orientation of the image and whether the characters of the image are read horizontally.

2. An apparatus as claimed in claim 1, wherein when a two point staple command is entered in a manual mode, said control means inhibits the stapling position from being automatically determined.

3. An apparatus as claimed in claim 1, wherein when the stapling position is inhibited from being automatically determined, said control means urges an operator to enter a desired stapling position in a manual mode.

4. An apparatus as claimed in claim 3, wherein said control means produces an alarm for urging the operator to change an orientation of documents.

5. An apparatus as claimed in claim 1, wherein when a stapling position is entered in a manual mode, said control means compares said stapling position with an automatically determined position and, if said stapling position entered differs from said automatically determined position, produces an alarm.

6. An apparatus as claimed in claim 1, wherein when stapling is continuously repeated the same stapling position, said control means determines a stapling position only for the first set of sheets.

7. An apparatus as claimed in claim 1, wherein said control means determines a stapling position on the basis of the sheet feed direction and said at least one of the angular orientation of the image and whether the characters of the image are read horizontally, wherein the image is an image of a cover page of a stack of pages.

8. An apparatus as claimed in claim 1, wherein when two point stapling is commanded, said control means determines whether or not the beginning of a writing is located at a stapling side and, if a result of the decision is negative, produces an alarm.

9. An image forming apparatus according to claim 1, wherein:

said recognizing means recognizes the angular orientation of the image by reading the image and examining an angular orientation of characters forming the image.

10. A method for determining a stapling position, comprising the computer implemented steps of:

determining an angular orientation of an image to be copied;

determining a sheet feed direction;

determining a stapling position using the determined angular orientation of the image to be copied and the determined sheet feed direction;

copying a plurality of images which include said image to be copied onto sheets; and stapling said sheets, onto which the plurality of images have been copied, at the determined stapling position.

11. A method according to claim 10, further comprising the step of:

manually entering a two point staple command;

wherein said step of stapling staples said sheets at two positions which correspond to the two point staple command.

12. A method according to claim 10, further comprising the steps of:

manually inhibiting the step of determining the stapling position from being performed; and urging an operator to enter a desired stapling position in a manual mode.

13. A method according to claim 12, wherein:

said urging step produces an alarm for urging the operator to change an orientation of said image to be copied.

14. A method according to claim 10, further comprising the steps of:

manually entering a stapling position;

comparing said stapling position which has been manually entered with said stapling position determined by said step for determining a stapling position;

producing an alarm when said comparing step determines that said stapling position which has been manually entered is different from said stapling position determined by said step for determining a stapling position.

15. A method according to claim 10, further comprising the step of:

repeating said copying step and said stapling step a plurality of times without repeating said step of determining the stapling position.

16. A method according to claim 10, wherein:

said step of determining an orientation of the image to be copied determines the orientation of a cover of a stack of documents.

17. A method according to claim 10, further comprising the steps of:

manually entering a two point staple command;

determining if a beginning of a writing is located at a stapling side when the two point staple command has been manually entered; and outputting an alarm when said step of determining if the beginning of a writing is located at the stapling side determines that the beginning of a writing is not located at the stapling side.

18. A method according to claim 10, wherein:

said step of determining an angular orientation of an image determines the angular orientation of the image by reading the image to be copied and examining an angular orientation of characters forming the image.

19. An image forming apparatus having a finisher with a plurality of stapling positions, comprising:

recognizing means for recognizing an orientation of an image; and control means for automatically determining a stapling position on the basis of the orientation of the image and a sheet feed direction;

wherein when a two point staple command is entered in a manual mode, said control means inhibits the stapling position from being automatically determined.

20. An image forming apparatus having a finisher with a plurality of stapling positions, comprising:

recognizing means for recognizing an orientation of an image; and control means for automatically determining a stapling position on the basis of the orientation of the image and a sheet feed direction;

wherein when the stapling position is inhibited from being automatically determined, said control means urges an operator to enter a desired stapling position in a manual mode.

21. An apparatus as claimed in claim 20, wherein said control means produces an alarm for urging the operator to change an orientation a document.

22. An image forming apparatus having a finisher with a plurality of stapling positions, comprising:

recognizing means for recognizing an orientation of an image; and control means for automatically determining a stapling position on the basis of the orientation of the image and a sheet feed direction;

wherein when a stapling position is entered in a manual mode, said control means compares the manual mode stapling position with the automatically determined position and, if said manual mode stapling position differs from said automatically determined stapling position, an alarm is generated.

23. An image forming apparatus having a finisher with a plurality of stapling positions, comprising:

recognizing means for recognizing an orientation of an image; and control means for automatically determining a stapling position on the basis of the orientation of the image and a sheet feed direction;

wherein when two point stapling is commanded, said control means determines whether or not the beginning of a writing is located at a stapling side and, if a result of the decision is negative, an alarm is generated.

24. A method for determining a stapling position, comprising the computer implemented steps of:

manually entering a two point staple command;

determining an orientation of an image to be copied;

determining a sheet feed direction;

determining two stapling positions using the determined orientation of the image to be copied and the determined sheet feed direction;

copying a plurality of images which include said image to be copied onto sheets; and stapling said sheets, onto which the plurality of images have been copied, at the two determined stapling positions which correspond to the two point staple command.

25. A method for determining a stapling position, comprising the computer implemented steps of:

determining an orientation of an image to be copied;

determining a sheet feed direction;

manually inhibiting a step of determining the stapling position which uses the determined orientation of the image to be copied and the determined sheet feed direction from being performed;

urging an operator to enter a desired stapling position in a manual mode copying a plurality of images which include said image to be copied onto sheets; and stapling said sheets, onto which the plurality of images have been copied, at the desired stapling position entered in the manual mode.

26. A method according to claim 25, wherein:

said urging step produces an alarm for urging the operator to change an orientation of said image to be copied.

27. A method for determining a stapling position, comprising the computer implemented steps of:

manually entering a stapling position;

determining an orientation of an image to be copied;

determining a sheet feed direction;

automatically determining a stapling position using the determined orientation of the image to be copied and the determined sheet feed direction;

copying a plurality of images which include said image to be copied onto sheets;

comparing said stapling position which has been manually entered with said stapling position which has been automatically determined;

producing an alarm when said comparing step determines that said stapling position which has been manually entered is different from said stapling position which has been automatically determined; and stapling said sheets, onto which the plurality of images have been copied, at the determined stapling position.

28. A method for determining a stapling position, comprising the computer implemented steps of:

manually entering a two point staple command;

determining if a beginning of a writing is located at a stapling side when the two point staple command has been manually entered;

outputting an alarm when said step of determining if the beginning of a writing is located at the stapling side determines that the beginning of a writing is not located at the stapling side;

copying a plurality of images which include said image to be copied onto sheets; and stapling said sheets, onto which the plurality of images have been copied, at two stapling positions which correspond to the two point staple command.

* * * * *

UNITED STATES PATENT AND TRADEMARK OFFICE

CERTIFICATE OF CORRECTION

PATENT NO. : 5,508,798

DATED : April 16, 1996

INVENTOR(S) : Kenji YAMADA

It is certified that error appears in the above-indentified patent and that said Letters Patent is hereby corrected as shown below:

On the title page, Item [54], and in Column 1, lines 1-5, the title is written incorrectly. In both places the title should read:

--[54] IMAGE FORMING METHOD AND APPARATUS WHICH DETERMINE STAPLING POSITION USING AN ORIENTATION OF AN IMAGE AND A SHEET FEED DIRECTION--

Signed and Sealed this

Sixth Day of August, 1996

*Attest:*

*Attesting Officer*

BRUCE LEHMAN

*Commissioner of Patents and Trademarks*